US005156303A

United States Patent [19]

Yamamoto et al.

[11] Patent Number: 5,156,303

[45] Date of Patent: Oct. 20, 1992

[54] ADHESIVE CONTAINER

[75] Inventors: Iwao Yamamoto, Aichi; Yasushi Ono, Toyama, both of Japan

[73] Assignee: Toa Gosei Chemical Industry Co., Ltd., Tokyo, Japan

[21] Appl. No.: 828,281

[22] Filed: Jan. 30, 1992

[30] Foreign Application Priority Data

Apr. 6, 1991 [JP] Japan ..... 3-31114

[51] Int. Cl.[5] ..... B65D 47/36

[52] U.S. Cl. ..... 222/568; 222/81; 222/107; 222/215

[58] Field of Search ..... 222/92, 107, 81, 83, 222/420, 215, 206, 568, 562, 548, 549, 551

[56] References Cited

U.S. PATENT DOCUMENTS

| | | | |
|---|---|---|---|
| 1,266,394 | 5/1918 | Brennesen | 222/568 |
| 2,873,886 | 2/1959 | Miskel et al. | 222/568 X |
| 3,016,173 | 1/1962 | Stull | 222/562 X |
| 4,049,160 | 9/1977 | Rumm | 222/568 X |
| 4,146,152 | 3/1979 | Ogawa et al. | 222/81 |
| 4,413,753 | 11/1983 | Stock | 222/149 |
| 4,498,609 | 2/1985 | Stock | 222/420 |
| 4,678,098 | 7/1987 | Oka | 222/81 X |
| 5,052,589 | 10/1991 | O'Meara | 222/107 X |

FOREIGN PATENT DOCUMENTS

| | | | |
|---|---|---|---|
| 2906818 | 11/1979 | Fed. Rep. of Germany | 222/420 |
| 2622795 | 5/1989 | France | 222/420 |
| 2636926 | 3/1990 | France | 222/420 |
| 0194751 | 11/1984 | Japan | 222/420 |
| 63-317468 | 12/1988 | Japan . | |

*Primary Examiner*—Kevin P. Shaver

*Attorney, Agent, or Firm*—Sughrue, Mion, Zinn, Macpeak & Seas

[57] ABSTRACT

An adhesive is filled in an adhesive-containing member, while positively fixing the adhesive-containing member, and after the filling of the adhesive, a nozzle can be positively capped on the adhesive-containing member at high speed. The adhesive-containing member 2 has a hollow cylindrical body 3 with a non-cylindrical bottom portion 7. A nozzle 8 includes a polygonal tubular portion 11 of square shape or regular polygonal shape in plan view, formed on an upper end of cylindrical proximal end portion 9. A cylindrical portion 12 thereof is formed integrally on the polygonal tubular portion 11 via a step portion, and a conical discharge portion 13 is formed integrally on the cylindrical portion 12. A recess 14 is formed in a central portion of an outer surface of a closed top of the discharge portion. Nozzles 8 are lined up in a predetermined direction, using the cylindrical portions 12, and then each nozzle is engaged with and retained by a nozzle tightening jig 21 having an inner peripheral surface substantially corresponding in shape to that of the polygonal tubular portion 11, and the nozzle tightening jig 21 is rotated, so that the nozzle 8 is capped at high speed on the adhesive-containing member 2 which is fixed by engaging its bottom portion 7 within a fixing jig 23.

1 Claim, 3 Drawing Sheets

ADHESIVE CONTAINER

FIELD OF THE INVENTION

This invention relates to an adhesive container best suited for holding an α-cyanoacrylate-type adhesive known as an instantaneous adhesive.

BACKGROUND OF THE INVENTION

In a representative example of adhesive container for holding an instantaneous adhesive, such as an α-cyanoacrylate-type adhesive, as disclosed in Japanese Laid-Open Utility Model Application No. 48-4046, Japanese Utility Model Publication No. 54-40352 and Japanese Laid-Open Utility Model Application No. 58-116576, a conical nozzle whose distal end is closed or not closed is threaded at its proximal end portion on the outer periphery of an upper end of a hollow cylindrical adhesive-containing member having a closed bottom.

In this type of adhesive container, an adhesive is poured into the adhesive-containing member through an upper end opening thereof after separating the nozzle therefrom, and then the opening is closed by tightening the nozzle. Such an adhesive container is best suited for use as a container for holding an α-cyanoacrylate-type adhesive which needs to be prevented from contact with the air, except when using it. Such container has a high utility.

Problems to be Solved by the Invention

As described above, in the above known adhesive container, when the adhesive is to be filled, the nozzle is separated from the adhesive-containing member, and in this condition the adhesive is filled in the adhesive-containing member by a feeding machine, and then the nozzle is attached to the adhesive-containing member. However, where the adhesive-containing member is in the form of a tube of cylindrical shape, and also the proximal end portion of the nozzle is cylindrical, when the two are to be threadedly connected together using a capping machine, it has been necessary to fix them by the use of jigs of a special shape so as to prevent the adhesive-containing member and the nozzle from rotating.

Further, when the nozzles are to be lined up at high speed, it is impossible to uniformly line up the nozzles since most nozzles have the conical nozzle portion formed integrally with the proximal end portion having the outer diameter generally equal to the diameter of the outer periphery of the adhesive-containing member. Besides, when the line-up is to be made using the proximal end portion of a certain outer diameter as a reference, a hopper feeder having a large diameter is needed, and further the number of the nozzles to be lined up at a time is limited. On the other hand, a line-up device of a relatively large size is needed for lining up many nozzles simultaneously. Because of these problems, it has been difficult to cap the nozzle for the adhesive-containing member at high speed.

It is therefore an object of this invention to provide an adhesive container in which an adhesive can be filled in an adhesive-containing member while positively fixing the adhesive-containing member, and a nozzle can be capped onto the adhesive-containing member at high speed after the filling of the adhesive.

SUMMARY OF THE INVENTION

An adhesive container according to the present invention is characterized by the provision of an adhesive-containing member having a neck portion formed integrally on an upper end of a hollow cylindrical body through a shoulder portion, said neck portion having a thread on its outer periphery and being open at its end. A lower end portion of said adhesive-containing member tapers toward a lower end thereof, so that the opposed walls of said lower end portion gradually approach each other to provide flat surface portions, respectively. The lower end is closed, and a nozzle including a cylindrical proximal end portion has at its inner surface a thread engaged with the thread formed on the neck portion. A polygonal tubular portion has a square or a regular pentagonal outer periphery in transverse cross-section, and further includes at an upper end of said proximal end portion an outer cylindrical peripheral portion integral with the polygonal tubular portion through a step portion. A tubular discharge portion is formed on a central portion of said cylindrical portion with a recess formed in a central portion of an outer end surface of a closed top of a discharge portion at a distal end thereof.

The adhesive container of the present invention comprises the adhesive-containing member, and the nozzle having the closed distal end. The adhesive-containing member, as well as the nozzle, are molded of a synthetic resin material such for example polyethylene and polypropylene which is inert relative to an adhesive to be contained.

The adhesive-containing member, that is, one of the parts constituting the adhesive container, has a cylindrical neck portion of a reduced diameter formed integrally on the upper end of the hollow cylindrical body through a smooth shoulder portion, and a thread (usually, an external thread) constitutes an inverse thread formed on the outer periphery of the neck portion, and the distal end of the neck is open.

The nozzle, that is the other part, includes the cylindrical proximal end portion having at an inner peripheral surface the other thread (internal thread) engaged with the thread formed on the neck portion, and the polygonal tubular portion which has a square or a regular polygonal outer periphery in transverse cross-section, is formed on the upper end of the proximal end portion thereof. The polygonal tubular portion may be formed integrally with the cylindrical 10 proximal end portion through an intermediate step portion. In either case, the nozzle is integrally injection-molded of a synthetic resin which is inert with respect to an α-cyanoacrylate-type adhesive.

The polygonal tubular portion of the nozzle is provided so as to prevent the nozzle from being unnecessarily angularly moved at the time of capping of the adhesive-containing member, and no particular problem arises when the polygonal tubular portion is basically polygonal in its plan view. As regards the adhesive-containing member to be filled with the α-cyanoacrylate-type adhesive because of the characteristics of the adhesive, the outer diameter of the cylindrical body is relatively small, usually, on the order of about 9.5 mm, and the outer diameter of the neck portion is relatively small on the order of about 6.8 mm, and hence, naturally, the outer diameter of the proximal end portion of the nozzle is small. Therefore, if the polygonal tubular portion is, for example, hexagonal in its plan view, the resin at the corner portions tends to be rounded by a jig, which results in an unsatisfactory tightening. And, where only opposed walls are made straight, the jig must be rotated through an angle of about 179 degrees at the maximum if the two opposed walls are out of position when attaching the nozzle to the jig. This prevents a high-speed nozzle attaching operation, and therefore a regular pentagonal shape or square shape is highly preferred.

The cylindrical portion is integrally formed on the polygonal tubular portion via the step portion. This cylindrical portion is fitted in a retaining hole for line-up purposes formed in a line-up device, thereby stably lining up the nozzles at high speed, and therefore its outer diameter is less than that of the polygonal tubular portion.

The line-up device for lining up the nozzles may have a pair of support levers spaced from each other by a distance substantially equal to the outer diameter of the cylindrical portion of the nozzle, in which case the cylindrical portion of each nozzle is engaged in a groove defined by the support levers, and the proximal end portion formed integrally with the cylindrical portion is engaged with the support levers for retaining purposes.

The discharge portion of the nozzle is formed integrally and coaxially at the upper end of the cylindrical portion, and may taper (that is, decreasing in diameter progressively) toward the distal end thereof, or may be a cylindrical portion of uniform small diameter. The top of the discharge portion of the nozzle is closed, and a recess is formed at the center of the outer surface of this closed top. A sharp pointed article, such as a needle, may readily pierce the recess of the top portion, thereby allowing discharge of the adhesive, contained in the adhesive-containing member, to the exterior.

Before the use of the adhesive container of the present invention, the nozzle having the discharge portion with the closed top is attached to the adhesive-containing member, and therefore the adhesive contained in the adhesive-containing member is completely isolated from the outside air. In use, a sharp pointed article such as a needle, pierces through the top at the recess of the discharge portion, thereby destroying the seal.

At this time, the recess of the discharge portion serves to guide the sharp pointed member, so that the piercing of the top can be effected easily and accurately.

In the adhesive container of the present invention, the cylindrical portion of the nozzle is provided with a step between the discharge portion and the cylindrical proximal end portion of the nozzle, and therefore the nozzles can be lined up in a predetermined direction on a line-up plate of a line-up device at high speed, using the cylindrical portions, and also after this lining-up, the nozzle is inverted to direct the discharge portion upwardly, and then an nozzle tightening device is fitted on the polygonal tubular portion, so that the nozzle can be positively capped on the neck portion of the adhesive-containing member at high speed.

The lower end portion of the cylindrical adhesive-containing member tapers toward the lower edge thereof, so that the opposed walls of the lower end portion gradually approach each other to provide non-curved, flat surface portions, respectively. Therefore, by fitting the bottom portion of the adhesive-containing member in a fixing jig having a recess identical in shape in this bottom portion, the adhesive-containing member and the nozzle can be more readily, positively connected together.

BRIEF DESCRIPTION OF THE DRAWINGS

One preferred embodiment of an adhesive container of the present invention will now be described in detail with reference to the accompanying drawings.

DESCRIPTION OF THE PREFERRED EMBODIMENT

Figure 1:
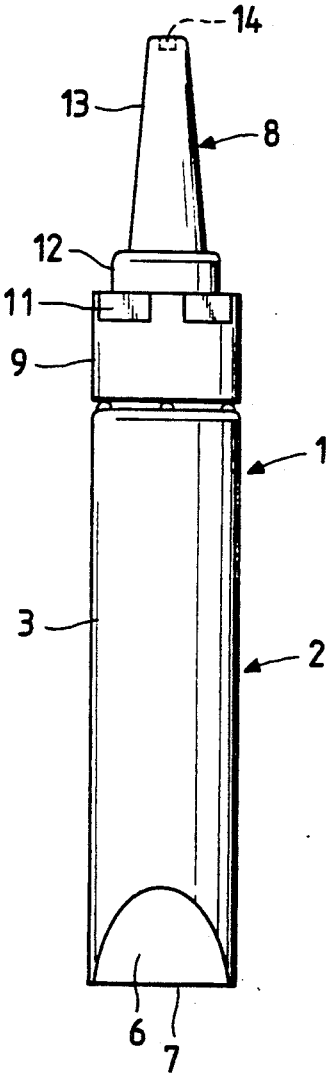
FIG. 1 is a front elevational view of one preferred embodiment of an adhesive container of the present invention.
Figure 2:
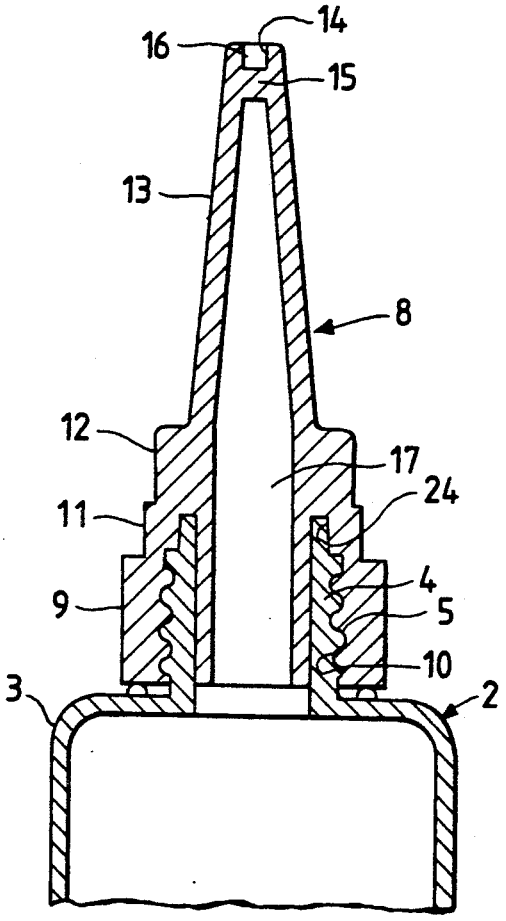
FIG. 2 is an enlarged cross-sectional view of an important portion of the adhesive container of FIG. 1.

The illustrated adhesive container, forming a preferred embodiment, serves to hold an α-cyanoacrylate-type adhesive. This adhesive container 1 consists of an adhesive-containing member 2 and a nozzle 8. Each of the adhesive-containing member 2 and the nozzle 8 is integrally molded of polyethylene which is inert relative to an α-cyanoacrylate-type adhesive to be carried thereby.

The hollow tubular adhesive-containing member 2 has a neck portion 4 of cylindrical form of a reduced diameter formed integrally at an upper end of a hollow cylindrical body 3 through a smooth rounded shoulder portion. An external inverse thread 5 is formed on the outer periphery of the neck portion 4 and the lower portion of the cylindrical body 3 tapers toward a lower end thereof, so that the opposed walls of this lower portion gradually approach each other to define non-curved, flat surface portions 6, respectively. This lower end of body 3 is closed, and a bottom portion of the adhesive-containing member 2 has a flat surface.

Figure 7:
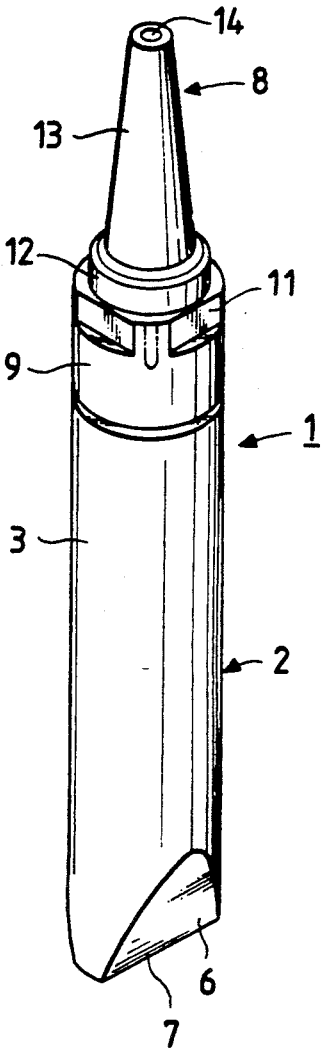
FIG. 7 is a perspective view of the adhesive container of the present invention.

The nozzle 8 has a proximal end portion 9 enveloping neck portion 4 of member 2 having a short, axial length, cylindrical inner periphery with a diameter generally equal to that of the outer periphery of the neck portion 4 of the adhesive-containing member 2, and an internal thread 10 for engagement with an external thread 5 formed on the outer periphery of neck 4. A polygonal tubular portion 11 of the nozzle 8 which has, in the illustrated embodiment, a square outer periphery in plan view and in transverse cross-section, is formed on the upper end of the nozzle proximal end portion 9. In order, a cylindrical reduced diameter portion 12 whose outer periphery is disposed radially inwardly of the four sides of the underlying square portion of the nozzle is formed integrally on the upper surface of the polygonal portion 11 as a step portion. A generally conical, tapered discharge portion 13, of decreasing diameter, progressively toward its distal end, is formed integrally on the center of the cylindrical portion 12 in step fashion as seen in the perspective view, FIG. 7.

Figure 3:
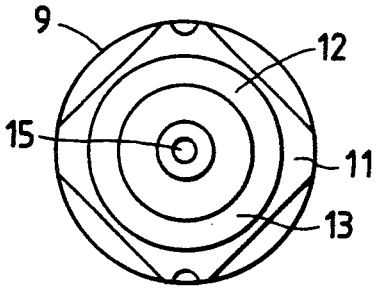
FIG. 3 is an enlarged plan view of a nozzle of the adhesive container of FIG. 1.
Figure 4:
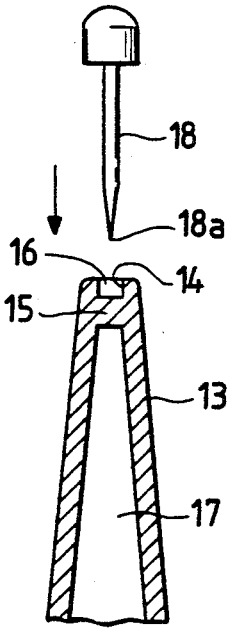
FIG. 4 is an enlarged front cross-section view of an important portion of the adhesive container of the present invention, showing a nozzle opening operation.

As is clear from FIGS. 3 and 4, a cylindrical recess 14 is formed in the center of the outer surface of the top of the discharge portion 13, and the recess 14 is closed off by a transverse closure wall 15 at the bottom of the recess to prevent the communication between a liquid discharge port 16, defined by the recess 14, and a liquid discharge passage 17 within the discharge portion 13. The nozzle 8 is provided with an annular groove 24 in the lower end of the proximal end portion thereof defining a hollow cylindrical guide which rides on the inner periphery of neck portion 4 of the adhesive-containing member 2.

In the adhesive container of the above construction, the α-cyanoacrylate-type adhesive is filled in the adhesive-containing member 2, and then the internal thread 10 formed at the proximal end 9 of the nozzle 8 is threaded onto the external thread 5 formed on the neck portion 4 of the adhesive-containing member 2, thereby closing the adhesive container 1 with the sealed adhesive therein. When the adhesive thus contained is to be discharged and used, a distal end 18*a* of a sharp pointed member 18, such as a needle, is inserted in recess 14, formed on the outer surface of the top of the nozzle 8, using the inner peripheral surface of the recess as a guide. The needle pierces through the closure wall 15 at the bottom of the recess 14 to open the seal, thereby communicating the liquid discharge port 16 with the liquid discharge passage 17.

For filling the adhesive in the adhesive container 1, a number of adhesive-containing members 2, as well as a number of nozzles 8 which are molded separately from the adhesive-containing members 2, are lined up by a line-up device, and the adhesive-containing members 2 are moved toward an adhesive filling device (not shown), with their neck portions 4 directed upwardly, and the α-cyanoacrylate-type adhesive is filled successively in each of the adhesive-containing members 2.

Figure 6:
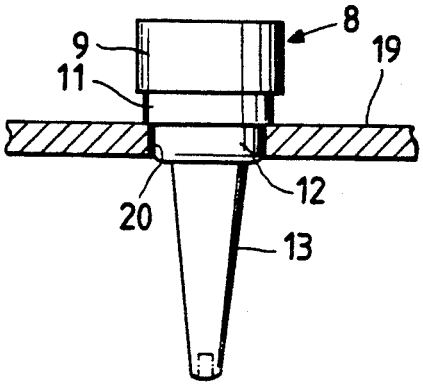
FIG. 6 is a side elevational view, showing a condition in which the nozzle of the adhesive container of the present invention is lined up by the use of a line-up device.

On the other hand, as shown in FIG. 6, the cylindrical portion 12 of each nozzle 8 is fitted in a retaining hole 20 of a line-up plate 19 of a line-up device, so that each nozzle 8 is suspended in an inverted manner, and all of the nozzles 8 are thus oriented in the same direction. Then the nozzles are inverted, so that the discharge portions 13 thereof are directed upwardly.

Figure 5:
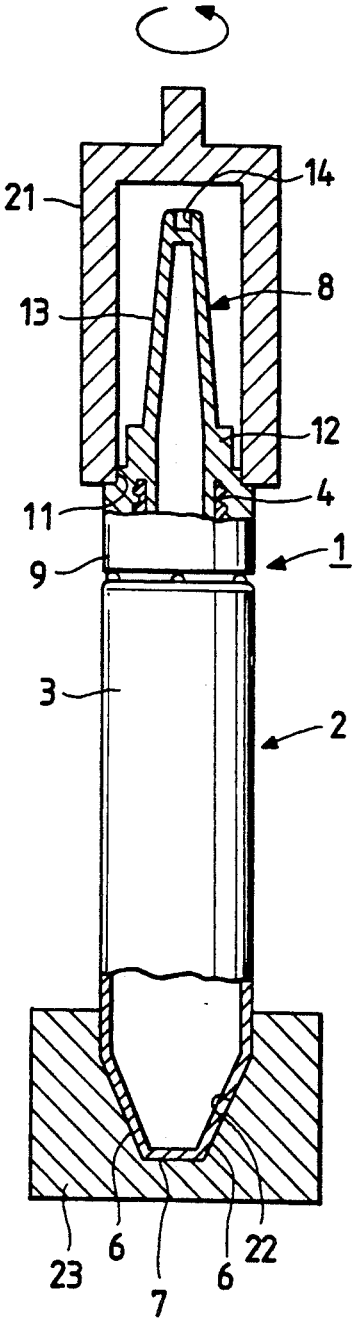
FIG. 5 is a partly broken, side elevational view, showing the process of attaching the nozzle to an adhesive-containing member of the adhesive container of the present invention.

Then as shown in FIG. 5, a nozzle tightening jig 21, which has an opening with an inner peripheral surface adapted to substantially snugly fit on the polygonal tubular portion 11 of the nozzle 8, is fitted on each of the upwardly-directed, lined-up nozzles 8 from above, and the nozzle tightening jig 21 holding the nozzle 8 is rotated, so that the internal thread 10 of the proximal end portion 9 of the nozzle 8 threadedly engages with the external thread 5 formed on the neck portion 4 of the adhesive-containing member 2. The bottom portion 7 of the adhesive-containing member 2 filled with the adhesive is fitted in a fixing jig 23 having a recess 22 of mirror shape to the shape of the bottom end or portion 7, thereby positively maintaining the adhesive-containing member in fixed position, and therefore the adhesive-containing member 2 and the nozzle 8 can be positively connected together more readily.

Advantageous Effects of the Invention

The adhesive container of the present invention comprises the adhesive-containing member for containing the adhesive, and the nozzle threadedly attached to the neck portion of the adhesive-containing member. The opposed walls of the lower end portion of the hollow cylindrical body of the adhesive-containing member approach each other progressively toward the lower end thereof to provide the non-cylindrical bottom portion having the non-curved, i.e. flat, opposite surface portions 6. Therefore, this bottom portion 7 is fitted in and retained by the fixing jig 23 having the recess of corresponding shape to this bottom portion, and when the nozzle is to be attached to the neck portion after the adhesive is filled, this attachment operation can be effected without rotating the adhesive-containing member at all, and the nozzle can be positively attached easily to the adhesive-containing member at high speed. Thus leakage of the adhesive and the introduction of the air (which causes the solidification of the adhesive) due to an incomplete tightening can be completely prevented.

The polygonal tubular portion of the nozzle 8, which is of square shape or other regular polygonal shape, in plan view, is formed on the upper end of the cylindrical proximal end portion of the nozzle engaged with the neck portion of the adhesive-containing member. Therefore, the polygonal tubular portion of the nozzle is fitted in the nozzle tightening jig of substantially corresponding cross-sectional shape to the polygonal tubular portion, and then the nozzle tightening jig is rotated, so that the nozzle 8 can be positively, threadedly attached to the neck of the adhesive-containing member at high speed. Further, since the polygonal tubular portion has a square shape or a regular polygonal shape, the corner portions thereof will not be rounded even if the nozzle tightening jig is rotated at high speed, and positive tightening of the nozzle can be achieved. Also, the nozzle can be easily attached to the nozzle tightening jig.

In the adhesive container of the present invention, the cylindrical portion is provided between the discharge portion and the proximal end portion of the nozzle through step portions, and therefore this cylindrical portion is fitted in the hole formed through the line-up plate of the line-up device, so that the nozzles can be easily lined up in a predetermined direction at high speed. The filling of the adhesive and the capping can be carried out at high speed, and therefore high-speed stable lining-up, high-speed supply and high-speed stable attachment can be more positively effected.

What is claimed is:

1. An adhesive container comprising: a hollow tubular adhesive-containing member having a neck portion formed integrally on an upper end of a hollow cylindrical body through a shoulder portion, said neck portion having a thread on its outer periphery and being open at an upper end; said adhesive-containing member having a lower end portion tapering toward a lower end thereof, so that opposed walls of said lower end portion gradually approach each other to provide opposite, non-curved surface portions, respectively, and said lower end being closed; a hollow tubular nozzle including a cylindrical proximal end portion having a thread on an inner peripheral surface engaged with said thread formed on said adhesive-containing member, a polygonal tubular portion having a square or a regular pentagonal outer periphery in transverse cross-section formed on an upper end of said proximal end portion thereof, a reduced diameter cylindrical portion formed integrally on said polygonal tubular portion through a step portion, and a tubular discharge portion formed on a central portion of said 2cylindrical portion, and a recess formed in a central portion of an outer surface of a closed top of said discharge portion.

* * * * *